US005195438A

United States Patent [19]

Dumoulin et al.

[11] Patent Number: 5,195,438

[45] Date of Patent: Mar. 23, 1993

[54] HEIGHT COMPENSATION DEVICE FOR RAILWAY TRUCK

[75] Inventors: Raymond Dumoulin, Rosemore; Denis Arvisais, St-Basile; Marc Brunet, St-Lambert; Benoit Lussier, Ste-Julie; Louis Thibault, St-Thomas d'Aquin, all of Canada

[73] Assignee: Bombardier Inc., Boucherville, Canada

[21] Appl. No.: 838,678

[22] Filed: Feb. 21, 1992

[51] Int. Cl.[5] ..... B61F 5/14

[52] U.S. Cl. ..... 105/199.3

[58] Field of Search ..... 105/199.3, 199.1

[56] References Cited

U.S. PATENT DOCUMENTS

| | | | |
|---|---|---|---|
| 3,401,991 | 9/1968 | MacDonnell | 105/199.3 |
| 3,523,505 | 8/1970 | Lich | 105/199.2 |
| 3,533,359 | 10/1970 | Williams | 105/199.3 |
| 4,108,080 | 8/1978 | Garner et al. | 105/199.3 |
| 4,434,720 | 3/1974 | Mulcahy et al. | 105/199.3 |
| 4,712,487 | 12/1987 | Carlson | 105/199.3 |
| 5,048,427 | 9/1991 | Dumoulin | 105/199.3 |

*Primary Examiner*—Robert J. Oberleitner
*Assistant Examiner*—Kevin D. Rutherford
*Attorney, Agent, or Firm*—Longacre & White

[57] ABSTRACT

A height compensation device for a railway truck having at least two pairs of rail engaging support wheels. The height compensation device is secured at opposed ends of a truck bolster and compensates for car body height loss after the wheels are re-profiled. The compensation device comprises a bearing element having a top support surface on which the car body rests. A displaceable height adjustment plate having one or more shim sections of different thicknesses is provided with one of the sections being disposed between the bearing element and the truck bolster by lifting the car body off the bearing element whereby to dispose the top support surface of the bearing element at a predetermined desired height above the truck bolster to maintain the car body at a substantially constant height from track level after wheel profiling.

9 Claims, 3 Drawing Sheets

HEIGHT COMPENSATION DEVICE FOR RAILWAY TRUCK

BACKGROUND OF INVENTION

1. Field of the Invention

The present invention relates to a height compensation device to compensate for car body height loss when the rail engaging support wheels of the railway truck are re-profiled after wear.

2. Description of Prior Art

It is known to provide height adjusting elements, such as shim pads, between the truck assembly and the railway car body to compensate for height loss due to grinding of the rail engaging support wheels of the truck assembly when these become worn Such height adjusters are, for example, described in co-pending U.S. application Ser. No. 515,417 filed on Apr. 27, 1990, now U.S. Pat. No. 5,048,427 issued on Sep. 17, 1991 and entitled Railway Truck Assembly with Side Bearing Height Adjuster. That patent application also discloses the importance of the provisions of such shim pads and the disadvantages and problems in replacing these pads. However, in that patent application, and also in other known prior art height adjusting devices, it is always necessary to add an additional shim plate or to replace an existing shim plate to effect the height adjustment. A problem with such height adjusters is that they can become dislodged during use and lost as they are not positively engaged, causing excessive damage and wear to the wheels. Because these adjusters are separate pieces, they are often lost in the retrofitting garages and errors can arise in selecting an improper shim pad when effecting a shim replacement. They are also difficult to install as disclosed in the referenced application.

SUMMARY OF INVENTION

It is therefore a feature of the present invention to provide a height compensation device which substantially overcomes all of the abovementioned disadvantages of the prior art.

Another feature of the present invention is to provide a height compensation device which is secured at opposed ends of a truck bolster and which is provided with one or more shim sections of different thickness which are selectively disposed between the bearing element and the truck bolster by solely lifting the car body off the bearing element and shifting an adjustable plate.

Another feature of the present invention is to provide a height compensation device which is permanently secured to the truck bolster and which is pivotally positionable to a selected one of two or more height adjustments by simply swivelling the height compensation device to shift a shim element of a different thickness in position.

Another feature of the present invention is to provide a height compensation device having two or more shim sections of different thicknesses, which after being selectively positioned in place, compensate for car body height loss after wheel profiling and wherein the device is locked in place.

Another feature of the present invention is to provide a height compensation device having two or more shim sections of different thicknesses which are selectively positioned under a bearing element which is displaceably retained for vertical movement over a top surface of a truck bolster and wherein the height compensation device has no loose parts.

According to the above features, from a broad aspect, the present invention provides a height compensation device for a railway truck having at least two pairs of rail engaging support wheels. The height compensation device is secured at opposed ends of a truck bolster and compensates for car body height loss after the wheels are re-profiled. The device comprises a bearing element having a top support surface on which the car body rests. Displaceable height adjustment means, having one or more shim sections of different thickness, is provided with one of the sections being disposed between the bearing element and the truck bolster by lifting the car body off the bearing element whereby to support the top support surface of the bearing element at a predetermined desired height above the truck bolster to maintain the car body at a substantially constant height from track level, after the wheels have been profiled.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
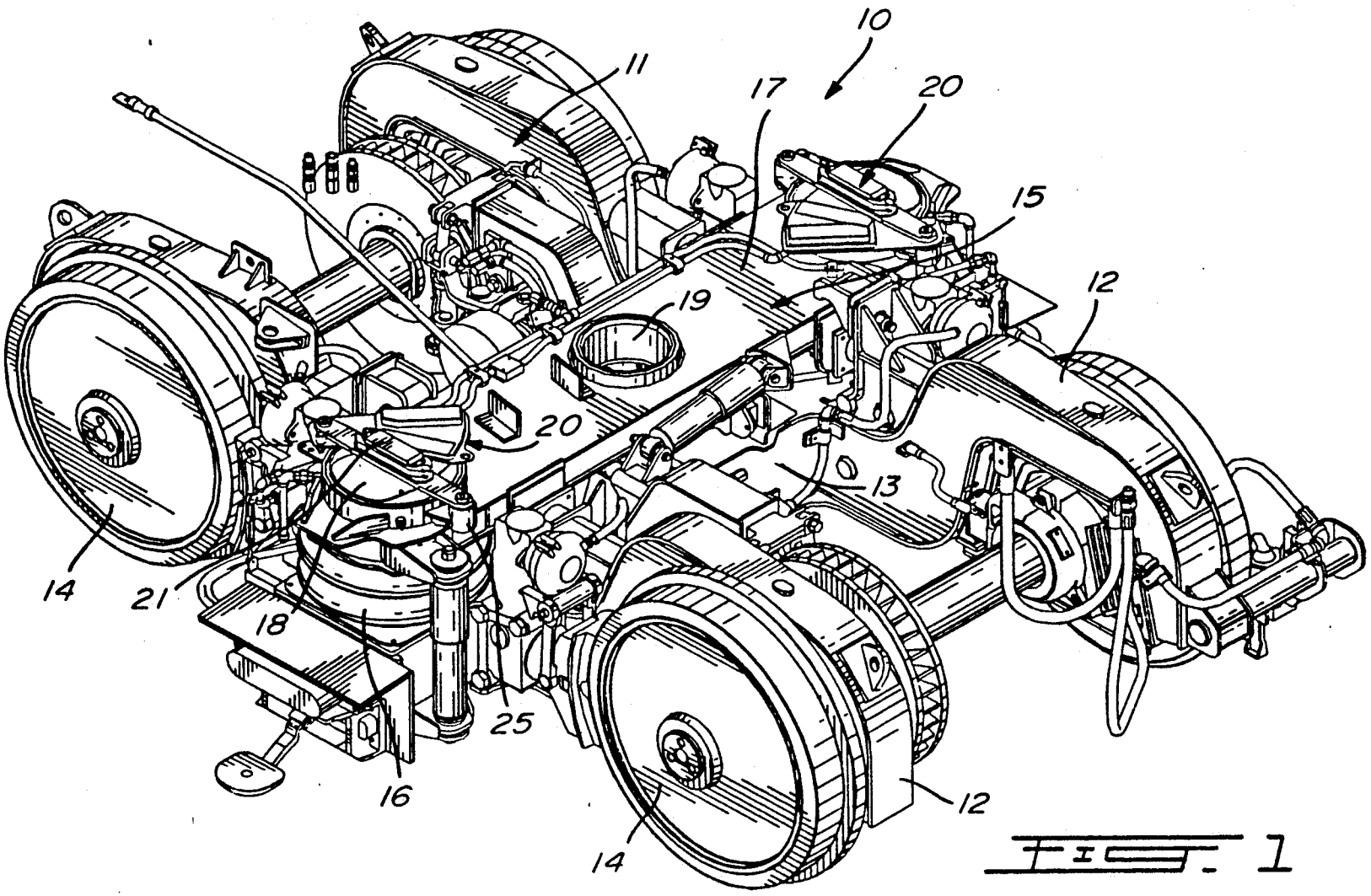
FIG. 1 is a perspective view showing the height compensation device of the present invention secured at opposed ends of the bolster of the truck assembly.

Referring now to the drawings, and more particularly to FIG. 1, there is shown a railway truck assembly 10 which comprises essentially a truck frame 11 having side frames 12 interconnected by a transom section 13 with a pair of wheel assemblies 14 secured at opposed ends of the truck frame. A bolster assembly 15 is connected to the truck frame 11 by a pneumatic suspension 16 and other connecting elements, as is well known in the art. The bolster assembly 15 is provided with a bolster beam 17 with support pads 18 disposed at opposed ends thereof. A car body pivot post receiving sleeve 19 is disposed centrally of the bolster beam 17, as is well known in the art.

Figure 5:
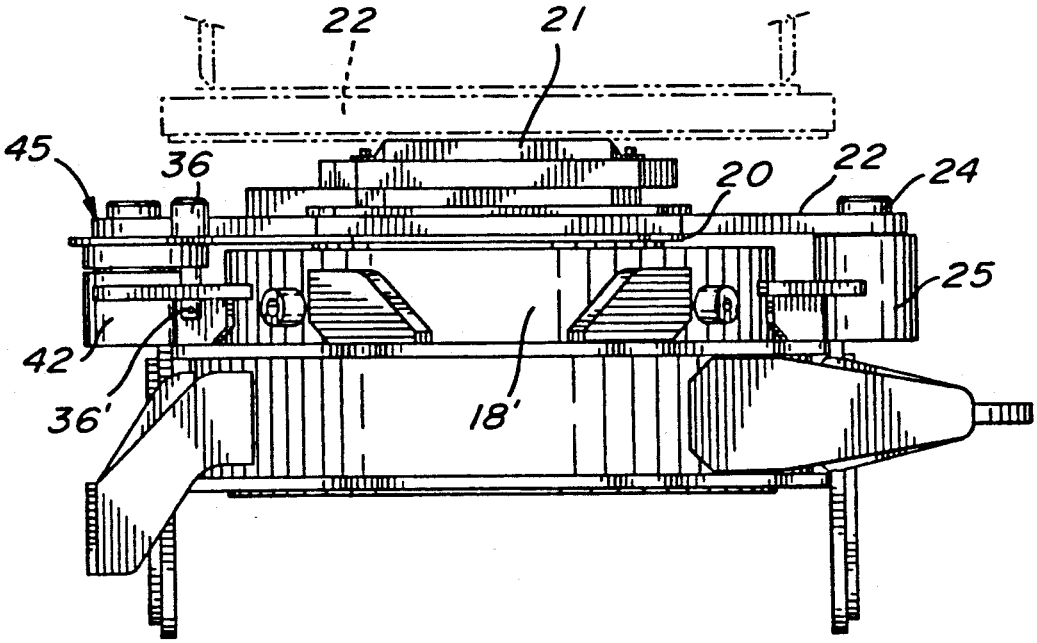
FIG. 5 is a side view showing the position of the height compensation device between the vehicle car body and the car bolster.

The height compensation device 20 of the present invention is supported over the support pads 18 and provides for shim adjustments of the bearing element 21 on which the railway vehicle car body 22' rests (see FIG. 5).

Figure 2:
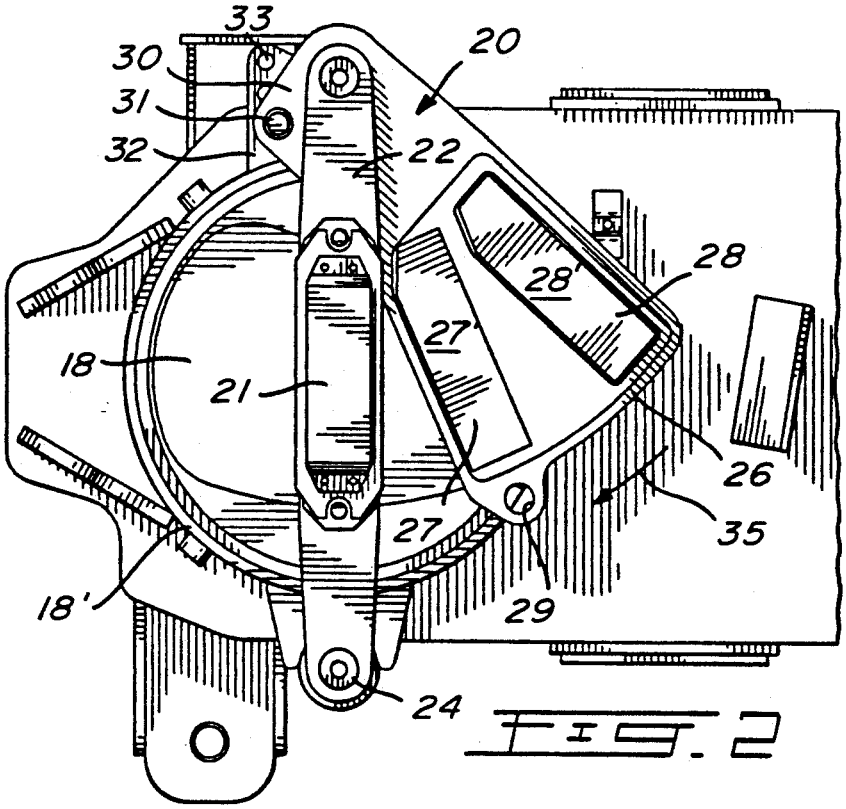
FIG. 2 is a top view of the height compensation device of the present invention.
Figure 3:
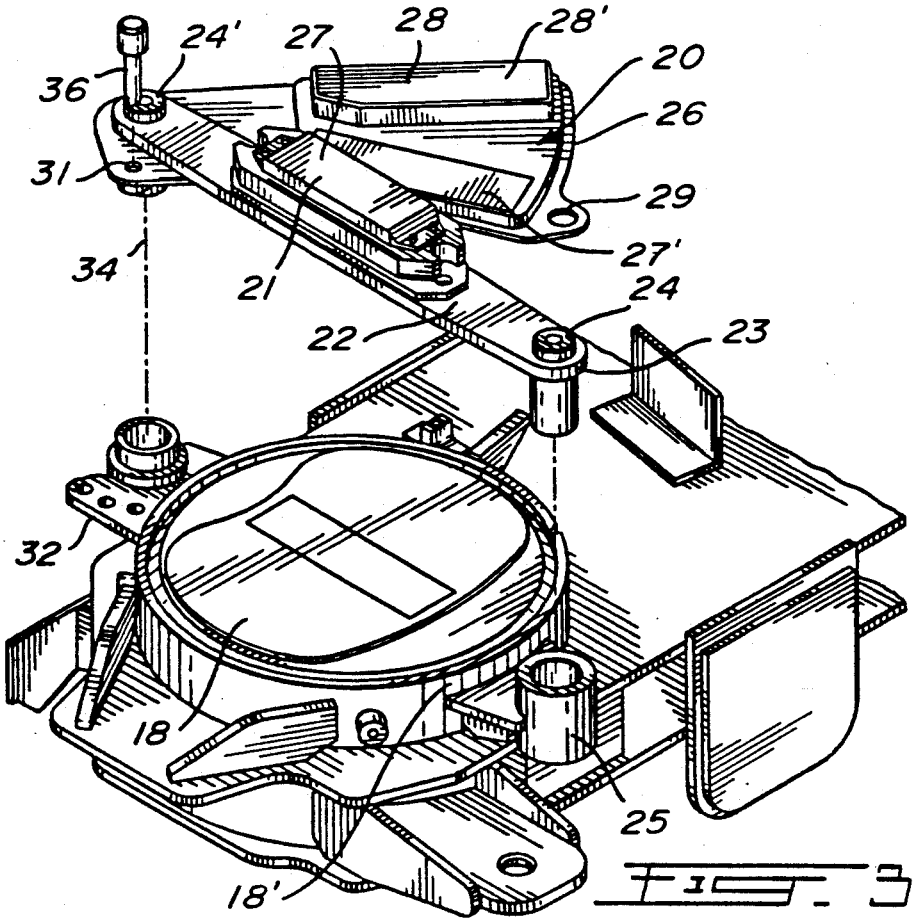
FIG. 3 is a perspective exploded view showing the assembly of the height compensation device.

Referring now additionally to FIGS. 2 to 5, there will be described the detailed construction of the height compensation device 20 of the present invention. As shown in FIGS. 2 and 3, the bearing element 21 is a bearing plate connected to a bridge arm 22 which is secured at opposed ends 23 by vertical guide means, herein defined by a spring biased guide post assembly 24, received in a cup-shaped coupling 25 which is secured to the support pad housing 18' secured to the truck bolster beam 17. This securement spring biases the bearing element 21 upwardly to facilitate shim adjustment. Accordingly, the bridge arm 22 is displaceably retained for vertical adjustment over a top surface of the support pads 18 or the truck bolster beam 17.

The height compensation device is comprised of a flat pivotal plate 26 which is pivotally retained about one of the guide post assemblies 24, herein guide post 24'. The pivotal plate 26 has one or more shim plates 27 and 28 secured to the flat top wall thereof. These plates define flat top support surfaces 27' and 28' which are positionable under the bridge arm 22. As shown in this embodiment, the bridge arm 22 can be supported at two additional elevated positions. Although there are preferably two shim plates, it is foreseen that more than two of the plates 27 and 28 may be provided.

As can be seen more clearly in FIGS. 1 to 3, the flat pivotal plate 26 extends in an area which is readily accessible for displacement about its pivot axis 34 when the car body is lifted and the bridge arm 22 moves upwardly. The plate has a hole 29 at a free end thereof for grasping the plate by a hook rod to draw it into position. The plate can also be displaced by hand or pushed in position by a hook rod or any other suitable tool. The pivotal plate 26 is further provided with a L locking flange section 30 also formed integral therewith, and having a pin receiving hole 31 therein. A stationary plate 32 is welded to the other side of the support pad housing 18' and has two or more holes therein, herein three holes 33 which are disposed on an arc of the pivot axis 34 of the guide post 24'. When the flat pivotal plate 26 is pivotally displaced in the direction of arrow 35, the hole 31 is displaced along the same arc as the holes 33 and lined up therewith whereby to receive an arresting pin 36 which passes through the hole 31 and a selected one of the holes 33 to ensure proper positioning of the pivotal plate 26 with the selected shim plate 27 or 28 disposed in alignment under the bridge arm 22. A clip (not shown) secures to a hole 36' at a bottom end of the pin 36 once in position.

Figure 4:
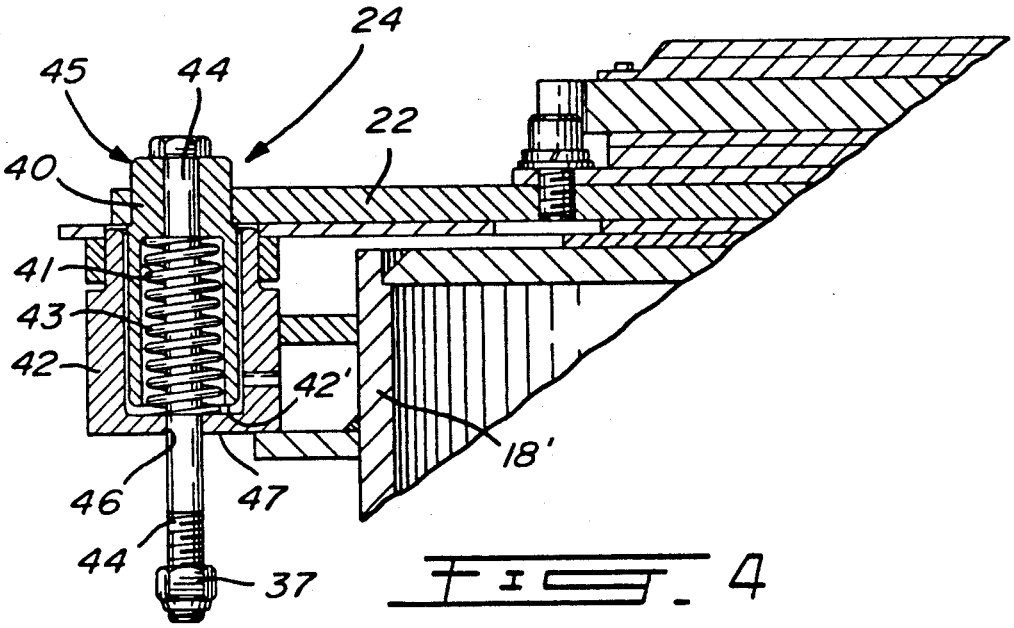
FIG. 4 is a partly sectioned side view of the coupling of the height compensation device to the truck bolster.

Referring now to FIG. 4, there is shown the construction of the guide post assembly 24. As herein shown, the guide post assembly 24 is comprised of a guide post section 40 which is a cylindrical post welded at a top end 45 to the lower face of the bridge arm 22. The guide post section extends under the bridge arm 22 and into a cup-shaped coupling 42 which is secured to the support pad housing 18' which is itself secured to the bolster beam 17. The guide post section 40 has a spring receiving cavity 41 in a bottom open end 42' thereof to receive an end section of the coil spring 43 which is disposed in the cup-shaped coupling 42 and retained captive therein by a connecting rod 44 which is secured at a top end 45 to the bridge arm 22 and which extends through a hole 46 provided in the bottom wall 47 of the cup-shaped coupling 42. The coil spring 43 biases the guide post section 40 upwardly whereby as soon as the railway vehicle car body 22' (see FIG. 5) is lifted off the bolster assembly, the bridge arm 22 lifts to its maximum clearance height which is limited by the position of the lock nut 37 which will abut the bottom wall 47 of the cup-shaped coupling, as shown on the right side of FIG. 5. This then permits the flat pivotal plate 26 to be displaced under the bridge arm 22 which has been lifted, to position a desired shim section or support surface 27' or 28' in alignment under the bridge arm 22. The lock pin 36 is then engaged to lock the pivotal plate in position and the car body 22' is then lowered back into position over the bearing element 21 but raised by the shim plate 27 or 28. Accordingly, one or more, herein two shim plates of different thicknesses, can be selectively positioned under the bearing element very rapidly without having to physically remove and interchange a shim plate.

Seeing that the shim plates are always present and form an integral part of the pivotal plate 26, these cannot be misplaced or lost as they always accompany the vehicle and, therefore, the wheels of the truck can be shimmed at any location where the railway car body can be lifted without having to transport the car to a specific retrofit yard. The adjustment can also be done without the use of special tools and it is only necessary to provide jacks to raise the car body from the bolster assembly.

It is within the ambit of the present invention to cover any obvious modifications of the preferred embodiment described herein, provided such modifications fall within the scope of the appended claims.

We claim:

1. A height compensation device for a railway truck having at least two pairs of rail engaging support wheels, said height compensation device being secured at opposed ends of a truck bolster and compensates for car body height loss after said wheels are re-profiled, said height compensation device comprising a bearing element having a top support surface on which said car body rests, a pivotal height adjustment plate having at least one shim section, said shim section being disposed between said bearing element and truck bolster by lifting said car body off said bearing element and pivoting said plate under said bearing element whereby to support said top support surface of said bearing element at a predetermined desired height above said truck bolster to maintain said car body at a substantially constant height from track level after wheel profiling.

2. A height compensation device as claimed in claim 1 wherein said pivotal height adjustment plate has two shim sections of different thickness.

3. A height compensation device as claimed in claim 2 wherein said bearing element is displaceably retained for vertical adjustment over a top surface of said truck bolster.

4. A height compensation device as claimed in claim 3 wherein said bearing element is a bearing plate supported on a bridge arm, said bridge arm being secured at opposed ends thereof by vertical guide means to cause said bridge arm to be guidingly displaced upwardly to position said selected one of said shim sections thereunder.

5. A height compensation device as claimed in claim 4 wherein said vertical guide means is a spring biased guide post interconnecting said opposed ends of said bridge arm to said truck bolster.

6. A height compensation device as claimed in claim 5 wherein said spring biased guide post is comprised of a guide post section secured to each of said opposed ends of said bridge arm and received in a cup-shaped coupling secured to said bolster, said guide post section having a cavity at an end thereof to receive an end section of a coil spring disposed in said cup-shaped coupling, and a connecting rod extending through said coil spring and secured at one end to one of said guide post sections or cup-shaped coupling and extending through and having arresting means at the other end thereof.

7. A height compensation device as claimed in claim 3 wherein said pivotal plate is provided with grasping means for effecting said pivotal displacement thereof.

8. A height compensation device as claimed in claim 6 wherein said pivotal plate is further provided with lock means to secure said plate with said selected one of said support platforms disposed under said bearing element.

9. A height compensation device as claimed in claim 8 wherein said lock means is comprised by a locking flange formed integral with said pivotal plate and having a pin receiving hole therein, a stationary plate disposed under said locking flange and having at least two holes therein disposed on an arc of a pivot axis of said pivotal plate, said pin receiving hole being displaceable over said arc to align said pin receiving hole with one of said holes in said stationary plate to receive an arresting pin therein to ensure proper positioning of a selected one of said support platforms under said bearing element.

* * * * *